US005427260A

United States Patent [19]

Mueller et al.

[11] Patent Number: 5,427,260

[45] Date of Patent: Jun. 27, 1995

[54] CLOSURE WITH INSERTABLE TAMPER INDICATOR

[75] Inventors: Bruce M. Mueller, Brookfield, Wis.; William O. Rowlands, Chicago, Ill.

[73] Assignee: Aptargroup, Inc., Crystal Lake, Ill.

[21] Appl. No.: 321,328

[22] Filed: Oct. 11, 1994

Related U.S. Application Data

[63] Continuation-in-part of Ser. No. 98,600, Jul. 28, 1993.

[51] Int. Cl.[6] ..... B65D 51/18

[52] U.S. Cl. ..... 215/254; 215/237; 215/253; 220/214; 222/153.07; 222/541; 222/556

[58] Field of Search ..... 215/203, 237, 245, 250, 215/253, 254, 258; 220/214, 265, 266, 270; 222/153, 541, 556

[56] References Cited

U.S. PATENT DOCUMENTS

| | | |
|---|---|---|
| 2,950,834 | 8/1960 | Mazza . |
| 3,480,184 | 11/1969 | Landis . |
| 3,651,992 | 3/1972 | Hazard . |
| 3,744,682 | 7/1973 | Blank . |
| 3,966,080 | 6/1976 | Bittel . |
| 4,022,352 | 5/1977 | Pehr . |
| 4,067,482 | 1/1978 | Vogel et al. . |
| 4,127,221 | 11/1978 | Vere . |
| 4,142,650 | 3/1979 | Almouli . |
| 4,170,315 | 10/1979 | Dubach et al. . |
| 4,244,495 | 1/1981 | Lorscheid et al. . |
| 4,265,367 | 5/1981 | Vogt . |
| 4,291,818 | 9/1981 | Nozawa et al. . |
| 4,361,250 | 11/1982 | Foster . |
| 4,371,088 | 2/1983 | Gach . |
| 4,397,400 | 8/1983 | Walter . |
| 4,431,110 | 2/1984 | Roth . |
| 4,460,100 | 7/1984 | Libit . |
| 4,467,931 | 8/1984 | Gach . |
| 4,487,324 | 12/1984 | Ostrowsky . |
| 4,512,486 | 4/1985 | Kobayashi et al. . |
| 4,592,480 | 6/1986 | Hart et al. . |
| 4,595,123 | 6/1986 | Libit . |
| 4,602,718 | 7/1986 | Dutt . |
| 4,610,371 | 9/1986 | Karkiewicz . |
| 4,711,363 | 12/1987 | Marino . |
| 4,711,372 | 12/1987 | Gach . |
| 4,711,380 | 12/1987 | Ulm . |
| 4,733,787 | 3/1988 | Knopf et al. . |
| 4,736,858 | 4/1988 | Shastal . |
| 4,763,801 | 8/1988 | Nycz . |
| 4,775,065 | 10/1988 | Shastal . |
| 4,778,072 | 10/1988 | Newman . |
| 4,796,771 | 1/1989 | Stettler . |
| 4,852,770 | 8/1989 | Sledge et al. . |
| 4,892,217 | 1/1990 | Shastal . |
| 4,919,286 | 4/1990 | Agbay, Sr. . |
| 4,941,592 | 7/1990 | Kitterman . |
| 4,969,574 | 11/1990 | Shastal . |
| 4,974,735 | 12/1990 | Newell et al. . |
| 5,012,941 | 5/1991 | Abrams et al. . |
| 5,123,561 | 6/1992 | Gross . |
| 5,133,470 | 7/1992 | Abrams et al. . |
| 5,201,440 | 4/1993 | Gross . |

FOREIGN PATENT DOCUMENTS

| | | |
|---|---|---|
| 1333334 | 10/1973 | United Kingdom . |
| WO94/03371 | 7/1993 | WIPO . |

*Primary Examiner*—Allan N. Shoap
*Assistant Examiner*—Nova Stucker
*Attorney, Agent, or Firm*—Dressler, Goldsmith, Shore & Milnamow, Ltd.

[57] ABSTRACT

A tamper-evident dispensing closure is provided with a base suitable for attachment to a container. The base has a deck defining a dispensing orifice and an anchor-receiving opening with an adjacent anchor-retention structure. A lid is provided to close the orifice and defines an aperture spaced from the dispensing orifice when the lid is seated on the base. A tamper-indicating element is provided with an anchor retained in the opening below the deck in the base. The element has a first segment extending from the anchor through the base opening, between the base and lid, and through the lid aperture. A second segment extends from the first segment and is disposed adjacent a portion of the lid to inhibit movement of the lid from the closed position. A first frangible connection joins the first and second segments at the lid aperture. Preferably, a second frangible connection joins the first segment to the anchor at the anchor-receiving opening in the base.

13 Claims, 5 Drawing Sheets

Fig. 5
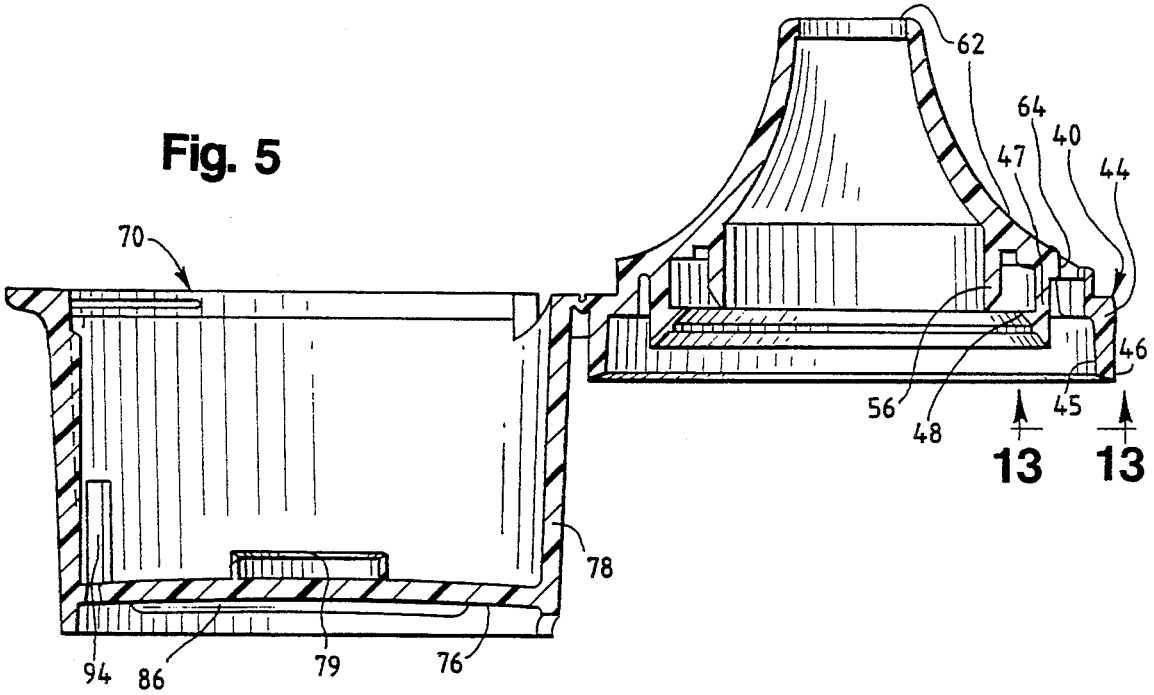
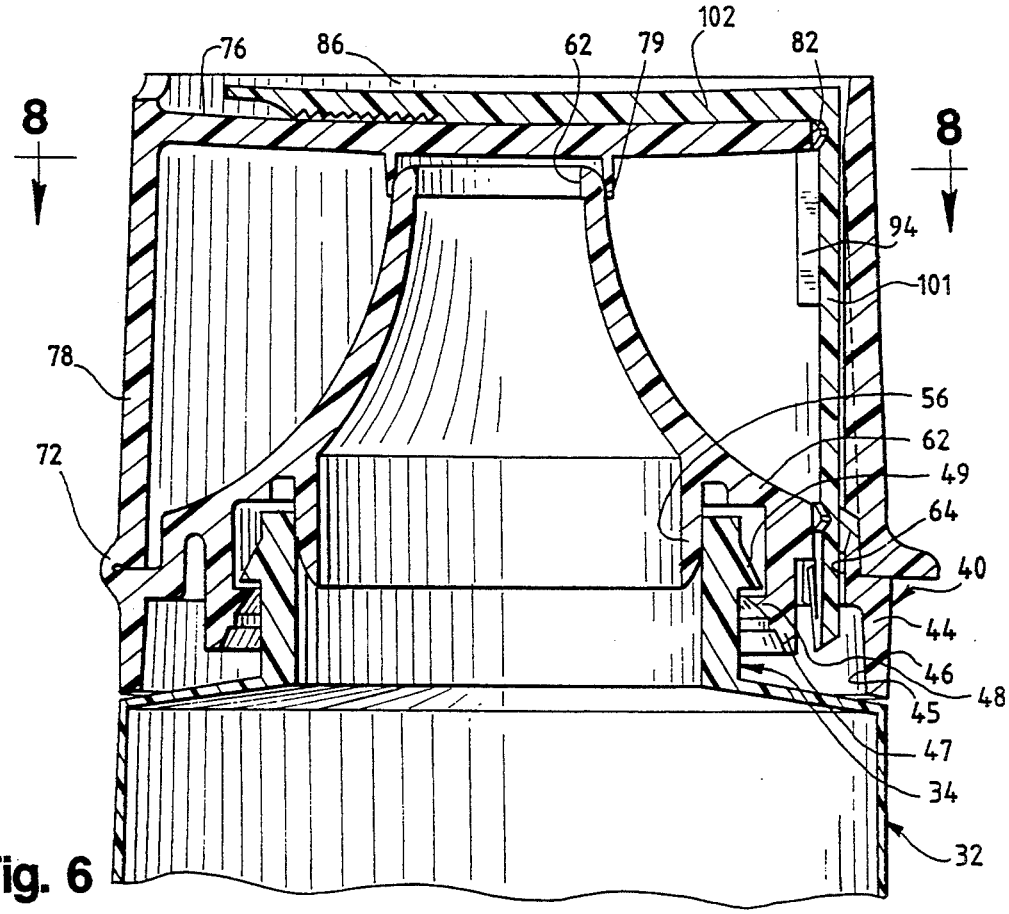
Fig. 6

Fig. 8
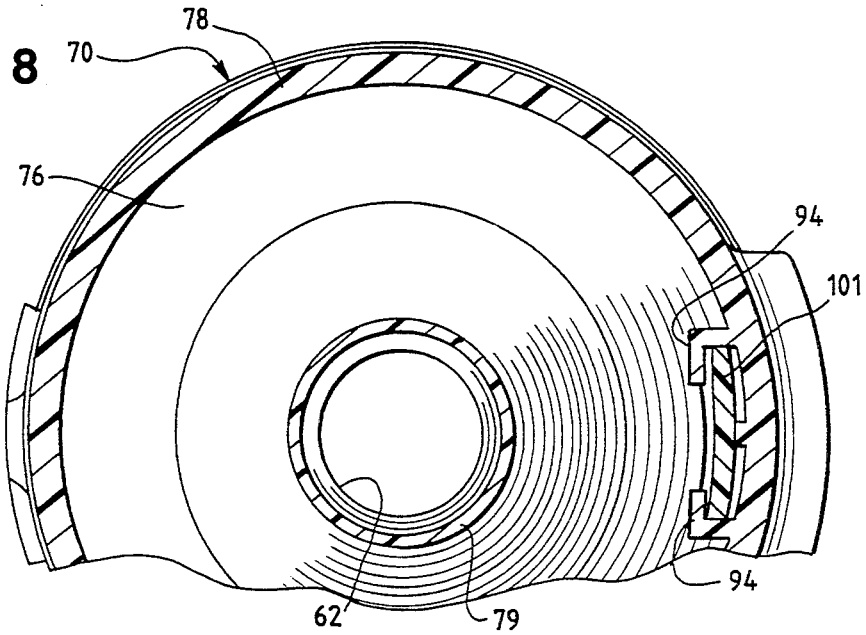
Fig. 9
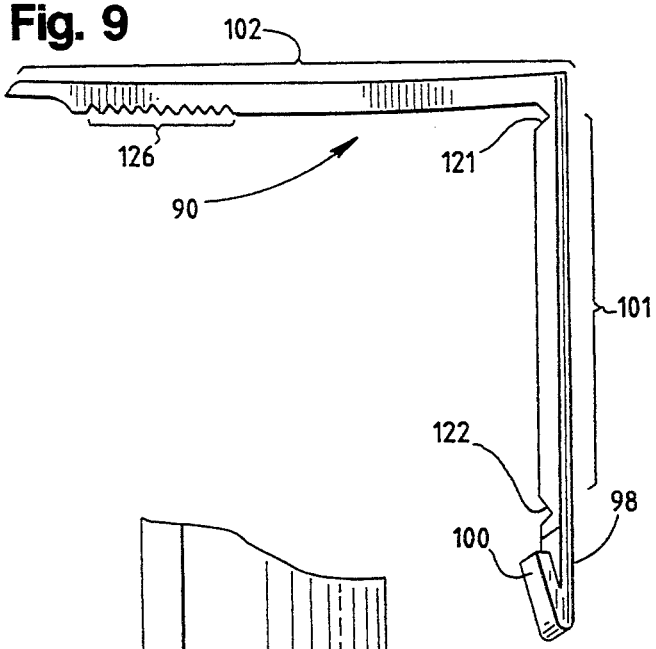
Fig. 10
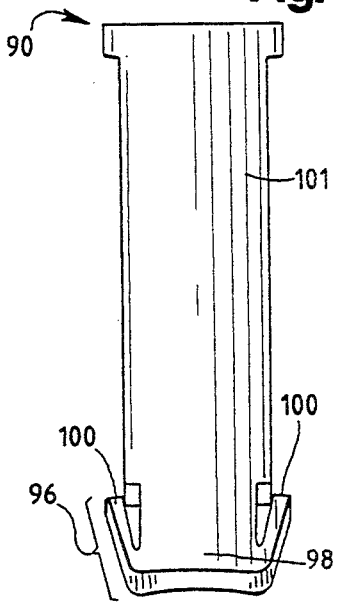
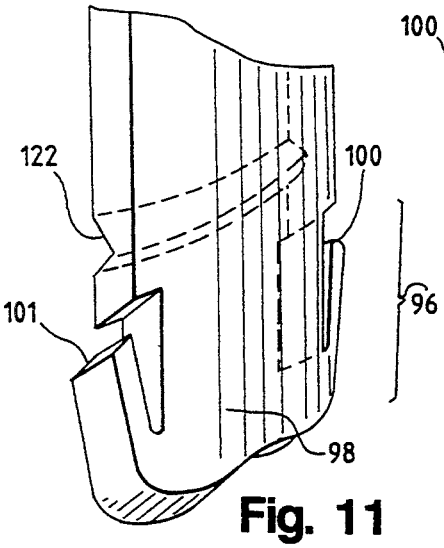
Fig. 11
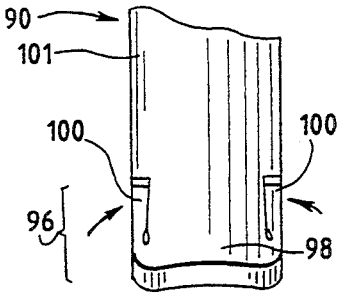
Fig. 12

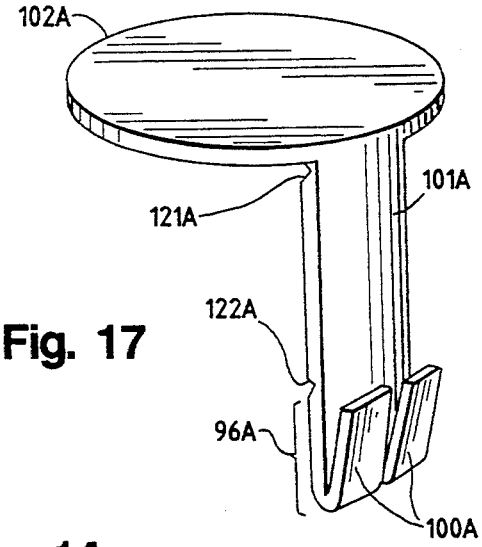
Fig. 17
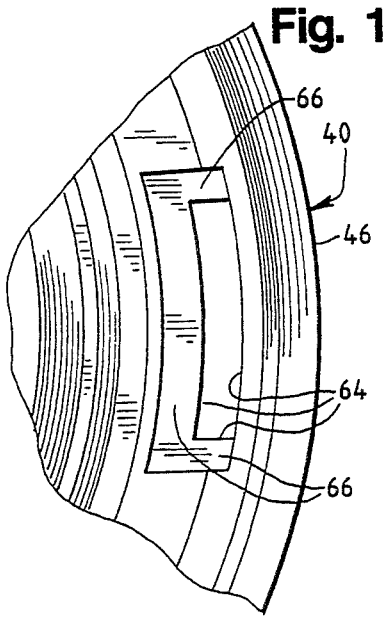
Fig. 13
Fig. 14
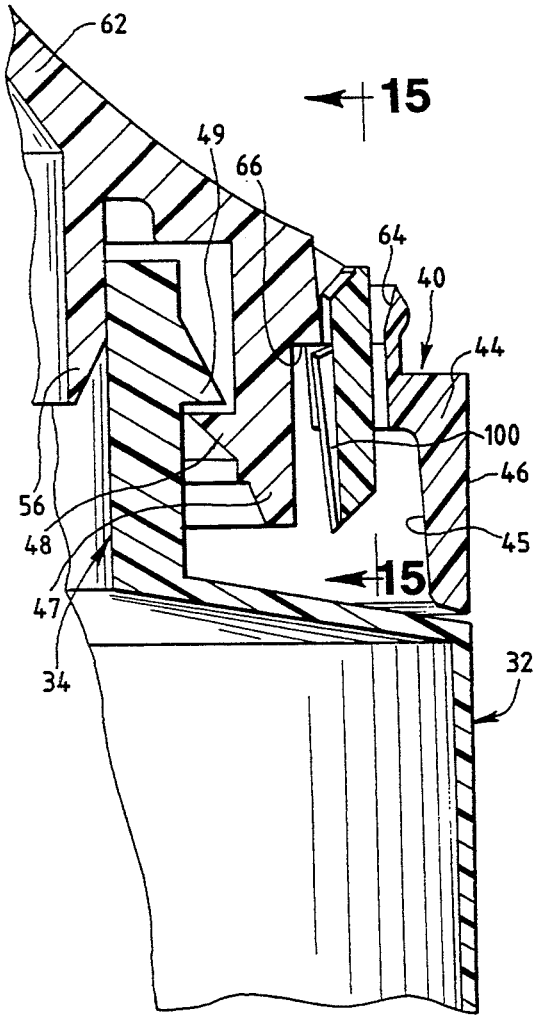
Fig. 15
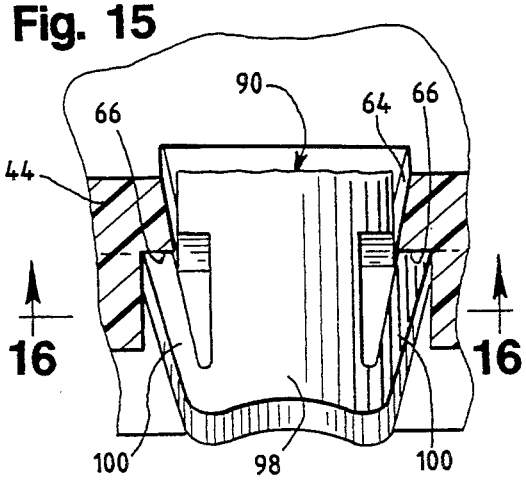
Fig. 16
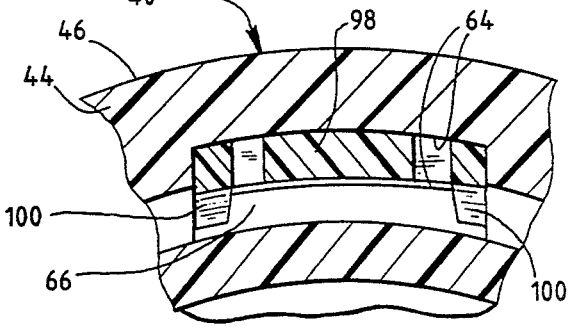

CLOSURE WITH INSERTABLE TAMPER INDICATOR

CROSS-REFERENCE TO RELATED APPLICATION

This application is a continuation-in-part application of U.S. patent application Ser. No. 08/098,600, filed on Jul. 28, 1993 by Bruce M. Mueller and William O. Rowlands.

TECHNICAL FIELD

This invention relates to a closure for a container and, in particular, to a closure which has a tamper-evident feature that can be readily manipulated by the user to permit opening of the closure while providing a clear indication of such manipulation.

BACKGROUND OF THE INVENTION AND TECHNICAL PROBLEMS POSED BY THE PRIOR ART

A variety of container closures have been developed or proposed wherein an initial opening of a lid or a dispensing spout structure provides visual evidence of such an occurrence—even after the lid or spout has been subsequently closed.

See, for example, the U.S. Pat. Nos. 4,487,324, 4,941,592, and 5,291,440 which are assigned to Seaquist Closures, Crystal Lake, Ill., U.S.A. The closures disclosed in these patents incorporate a locking band or tab which is attached to the lid and/or body of the closure with frangible webs so as,to initially retain the closure lid on the body in the closed position. To initially open the closure, the user must break the frangible webs by pushing or pulling on the tab or band.

While these closures can function well for the purposes for which they have been designed, it would be desirable to provide an improved tamper-evident closure which could be readily fabricated by the closure manufacturer and which does not require subsequent operations by the packager such as the addition of shrink sleeves, mechanical sleeves, adhesive strips, or the like.

Such an improved closure should also preferably accommodate use with different types of lids or flow control elements and should preferably, prior to the initial opening, blend in with, or enhance, the cosmetic appearance of the closure.

Further, it would be advantageous if such an improved closure could be initially opened relatively easily by the user.

It would also be beneficial if such an improved closure could be adapted for use on a variety of closure designs so as to furnish a very clear indication that the closure has been initially opened.

It would also be desirable to provide an improved tamper-evident closure design wherein a portion of the closure could be easily, and completely, removed for use as a "proof-of-purchase" panel or label.

The present invention provides an improved closure which can accommodate designs having the above-discussed benefits and features.

SUMMARY OF THE INVENTION

The present invention provides a novel tamper-evident dispensing feature which blends well with, and/or enhances, the cosmetic appearance of the closure and yet can be easily manipulated by the user to permit the closure to be opened. It gives a clear indication of an initial opening of the closure. The feature can be adapted for use in a variety of dispensing closure designs.

The feature can be readily incorporated in a closure that is not difficult to manufacture. After the closure is applied to the container by the packager, no further operations are required to render the tamper-evident feature effective.

The feature can be incorporated in a closure having a base suitable for attachment to a container. The base has a deck defining a dispensing orifice for communicating with the interior of the container. The base defines an anchor-receiving opening for receiving the anchor of a tamper-indicating element, and the base also has an anchor-retention structure adjacent the opening.

The closure includes a lid which is adapted to be seated on the base in a predetermined orientation to occlude the dispensing orifice. The lid defines an aperture spaced from the dispensing orifice when the lid is seated on the base. When the below-described tamper-indicating element is manipulated in a certain way, the lid can be moved from the seated orientation away from the dispensing orifice to permit the dispensing of the container contents through the dispensing orifice.

A tamper-indicating element is provided with an anchor retained in the opening below the base deck by the anchor-retention structure. The tamper-indicating element has a first segment extending from the anchor through the base opening, between the base and the lid, and through the lid aperture.

The tamper-indicating element has a second segment extending from the first segment and disposed adjacent a portion of the lid for inhibiting movement of the lid from the seated orientation. Finally, a first frangible connection joins the first and second segments at the lid aperture. The second segment can be pulled to separate the second segment from the first segment at the first frangible connection. This permits movement of the lid to expose the first segment as an indication that the closure has been opened.

In a preferred form, the tamper-indicating element also includes a second frangible connection joining the second segment to the anchor at the anchor-receiving opening in the base. Then, after the second segment is initially pulled to separate the second segment from the first segment at the first frangible connection, and after the lid is moved to expose the first segment, the first segment can then be pulled to separate the first segment from the anchor at the second frangible connection. This leaves the anchor visible in the anchor-receiving opening as an indication that the closure has been opened.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

FIG. 5 is a cross-sectional view taken generally along the plane 5—5 in FIG. 4;

FIG. 6 is an enlarged, fragmentary, cross-sectional view taken generally along the plane 6—6 in FIG. 1;

FIG. 8 is a fragmentary, cross-sectional view taken generally along the plane 8—8 in FIG. 6;

FIG. 9 is a side elevational view of the tamper-indicating element;

FIG. 10 is a rear elevational view of the tamper-indicating element;

FIG. 11 is a greatly enlarged, fragmentary, perspective view of the anchor portion of the tamper-indicating element;

FIG. 12 is a fragmentary view similar to FIG. 10 showing the anchor arms deflected inwardly from the outwardly diverging orientation shown in FIG. 10;

FIG. 13 is a fragmentary, bottom plan view of the portion of the closure base in which the anchor-receiving opening is located;

FIG. 14 is a greatly enlarged, fragmentary view similar to FIG. 6 but with the lid moved away and with the tamper-indicating element first and second segments separated from the anchor;

FIG. 15 is a fragmentary, cross-sectional view taken generally along the plane 15—15 in FIG. 14;

FIG. 16 is a cross-sectional view taken generally along the plane 16—16 in FIG. 15; and FIG. 17 is a perspective view of an alternate embodiment of the tamper-indicating element.

DESCRIPTION OF THE PREFERRED EMBODIMENT

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the closure of this invention is described in a normal (upright) storage position, and terms such as upper, lower, horizontal, etc., are used with reference to this position. It will be understood, however, that the closure of this invention may be manufactured, stored, transported, used, and sold in an orientation other than the position described.

Some of the figures illustrating embodiments of the closure show structural details and mechanical elements that will be recognized by one skilled in the art. However, the detailed descriptions of such elements are not necessary to an understanding of the invention, and accordingly, are not herein presented.

Figure 1:
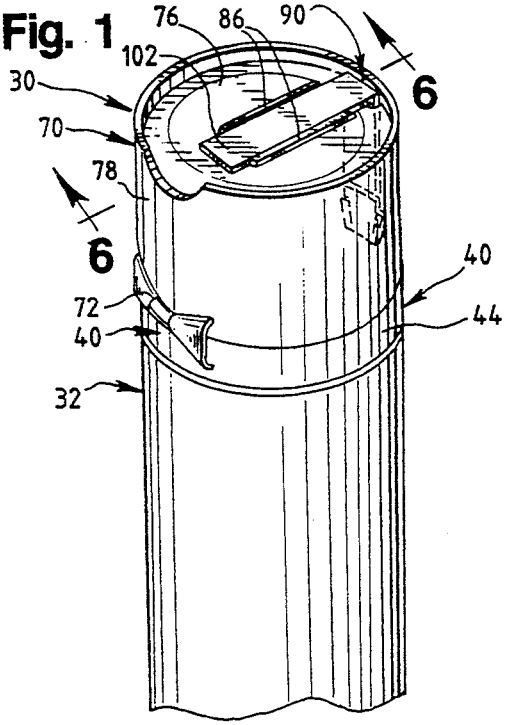
FIG. 1 is a fragmentary, perspective view of a first embodiment of the closure according to the present invention shown mounted on a container.
Figure 3:
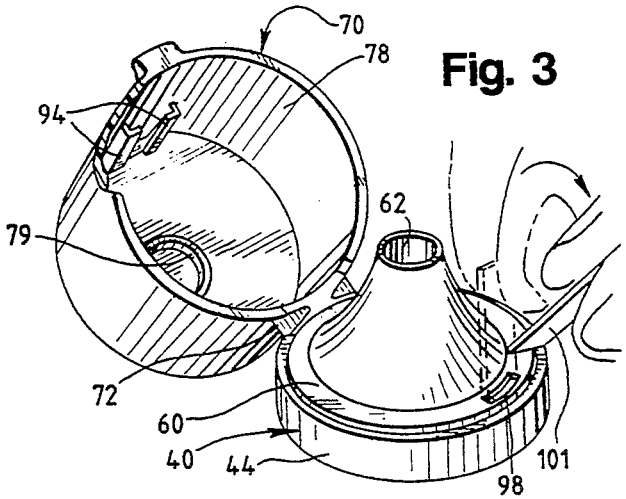
FIG. 3 is a perspective view of the closure with the lid opened and with the first segment of the tamper-indicating element being removed.
Figure 4:
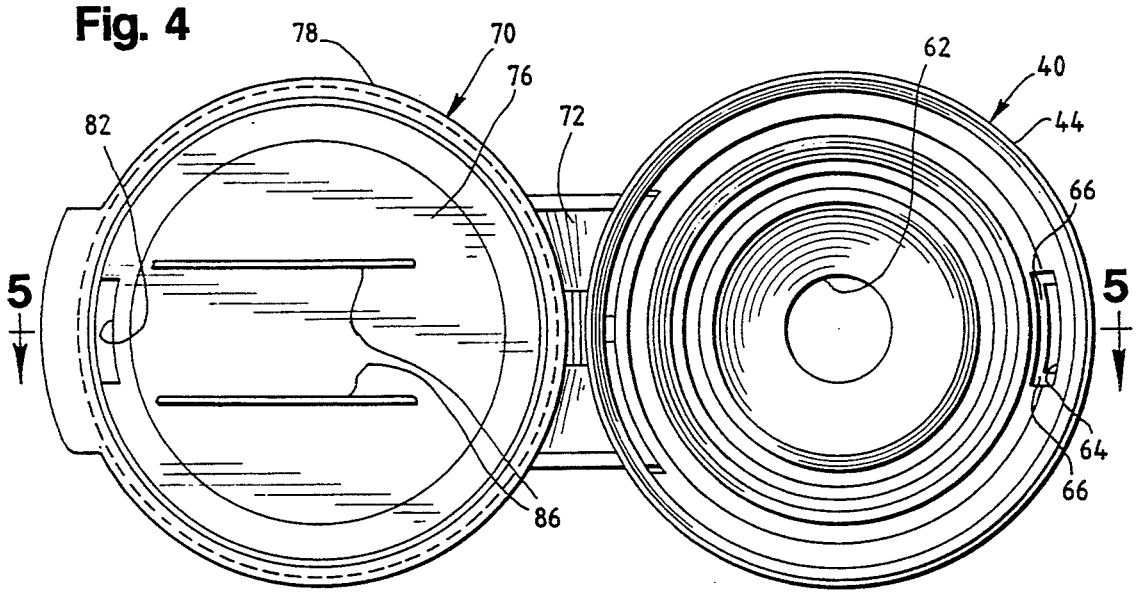
FIG. 4 is a bottom plan view of the closure in the fully open, as-molded condition prior to assembly with the tamper-indicating element.

A first form of a closure having a tamper-evident feature is illustrated in FIGS. 1–16 and is designated generally therein by the reference numeral 30 (FIGS. 1 and 4). The closure 30 is adapted to be mounted on a container 32. The container 32 may be of any suitable special or conventional type and typically has a neck 34 (FIG. 4) which receives the closure 30 and which defines an opening 36 through which the container contents can be dispensed. The container 32 is preferably fabricated from thermoplastic material, or other materials, compatible with the container contents and which accommodate squeezing of the container.

The container 32 may have a variety of different shapes, sizes, and constructions. In the embodiment illustrated in FIG. 1, the container 32 has a generally cylindrical configuration projecting below the closure.

Typically, the container 32 is filled with a fluid consumer product, such as a skin lotion, a hair care product, or the like. Such containers may also hold fluid food items, household cleaners, and other types of consumer products, as well as commercial, industrial, and institutional products.

The container 32 would typically be shaped, sized, and constructed so as to facilitate the containment and dispensing of the particular product in the specific application for which the product is sold. Typically, the container 32 is molded from a suitable thermoplastic material to form a unitary structure. The side wall is preferably elastically deformable or flexible to accommodate manually applied pressure for squeezing the container. When the container closure 30 is in the open, dispensing position while the container 32 is squeezed, the fluid material within the container is forced out of the container through the open, dispensing closure. The wall of the container is sufficiently resilient to return to the unstressed, undeformed configuration when the squeezing pressure is released.

As best illustrated in FIGS. 1, 3, 5, and 6, the closure 30 includes a housing, base, or body 40 for securement to the container 32. The closure base 40 includes a peripheral wall in the form of a skirt 44 which has an interior surface 45 and an exterior surface 46 (FIGS. 5 and 6).

As shown in FIG. 6, the skirt 44 includes a conventional inner collar 47 with a snap-fit bead 48 or other suitable means (e.g., a thread (not illustrated)) for engaging a suitable cooperating means, such as a bead 49, on the container neck 34 to secure the closure body 40 to the container 32. Preferably, the attachment of the closure base 40 to the container 32 is sufficiently secure so as to prevent easy removal of the closure from the container, or to prevent the closure from being reassembled on the container by a consumer. In some applications the closure base could be formed as a unitary part of, or bonded to, the container.

The closure base 40 also includes a resilient, internal ring 56 which functions as a seal by protruding into and against the container neck 34.

As best illustrated in FIGS. 3 and 4, the closure base 40 includes an upwardly projecting deck 60. The deck 60 has a spout or nozzle configuration defining a dispensing orifice 62. A peripheral part of the deck 62 defines an anchor-receiving opening 64. The opening 64 has a curved slot configuration as viewed in plan (FIG. 4). As shown in FIG. 13, the closure base interior surface 45 defines a slightly raised engaging surface or land 66 around part of the opening 64.

A lid 70 is hingedly connected by a hinge means or hinge 72 to the edge of the base 40. The lid 70 is adapted to be pivoted between (1) a closed position (FIGS. 1 and 6) seated on the base 70 for preventing flow of the container-stored contents through the closure and (2) an open position (FIGS. 3–5) moved away from the closed position permitting the dispensing of the container-stored contents from the base discharge aperture.

The lid 70 is shown in FIGS. 4 and 5 in a fully opened, as molded, position. It will be appreciated that the lid 70 need not be moved to the completely open position in order to permit the dispensing of the container contents. Further, a hinged connection between the lid 70 and base 40 is not required. In some applications, it may be desired to provide a completely removable lid.

In the preferred embodiment illustrated, the hinge 72 is a snap-action hinge of the conventional type described in the U.S. Pat. No. 4,403,712. However, if a hinge is employed, it is not required that the hinge be a snap-action type hinge. Any suitable hinge system may be employed for connecting the lid 70 to the base 40 consistent with the particular application requirements, aesthetics, manufacturing techniques, etc.

Preferably the lid 70 and the closure base 40 are molded as a unitary structure from suitable thermoplastic materials, such as polypropylene or polyethylene. However, the lid 70 and base 40 could be formed as separate pieces for subsequent assembly with a suitable connecting hinge system. The detailed design and operation of the hinge per se form no part of the present invention. The lip 70 and base 40 could also be formed as separate pieces adapted to be removably secured together via a threaded or snap-fit connection.

The lid 70 preferably includes a central deck or cover panel 76 and has a peripheral skirt 78 depending from the periphery of the central cover panel 76.

In the illustrated embodiment, the lid 70 also includes an annular sealing member 79 (FIGS. 3, 5, and 6) which projects from the central cover panel 76. The sealing member 79 is adapted to engage the exterior of the nozzle around the dispensing opening 62 when the lid 70 is closed (FIG. 6).

The lid 70 defines an aperture 82. When the lid 70 is in the closed position (FIG. 6), the aperture 82 is adjacent, and preferably vertically aligned with, the anchor-receiving opening 64 in the base 40.

Figure 2:
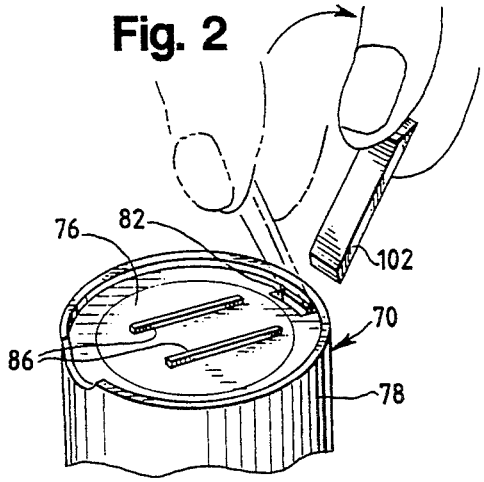
FIG. 2 is a view similar to FIG. 1 but showing the closure with the second segment of the tamper-indicating element being removed.

The lid cover panel 76 also defines a pair of outwardly projecting ribs 86, and the portion of the panel 76 between the ribs functions as a platform for receiving a portion of a tamper-indicating member 90 (FIG. 1). The ribs 86 may be omitted, if desired, and the ribs 86 form no part of the present invention. Another portion of the member 90 is guided below the panel 76 along the interior surface of the lid skirt 78 by a pair of spaced-apart, parallel channels 94 (FIGS. 2 and 8).

The tamper-indicating element 90 has a generally L-shaped configuration (FIG. 9). At one end of the tamper-indicating element 90 is an anchor 96 (FIGS. 9–12). The anchor 96 includes a stem 98 and a pair of arms 100 which each have a laterally divergent orientation relative to the stem 98. The arms 100 are resiliently deflectable between the divergent orientation illustrated in FIGS. 10 and 11 and an inwardly deformed position illustrated in FIG. 12.

The tamper-indicating element 90 includes a first segment 101 and a second segment 102. A first frangible connection 121 joins the first segment 101 and second segment 102. A second frangible connection 122 joins the first segment 101 to the anchor stem 98.

In the preferred embodiment, the tamper-indicating element 90 is made from a synthetic polymer material such as polypropylene, polyethylene, or polystyrene. Preferably, each frangible connection 121 and 122 is a web formed from a reduced thickness section of the material across the width of the tamper-indicating element 90. In the illustrated preferred embodiment the material has a V-shaped notch defining the web.

At the distal end of the tamper-indicating second segment 102, a toothed or serrated surface 126 is provided to assist the consumer in gripping or grasping the tamper-indicating element 90. Further, as can be seen in FIGS. 8, 11, and 16, the transverse cross section of the first segment 101 is slightly bowed or curved.

Figure 7:
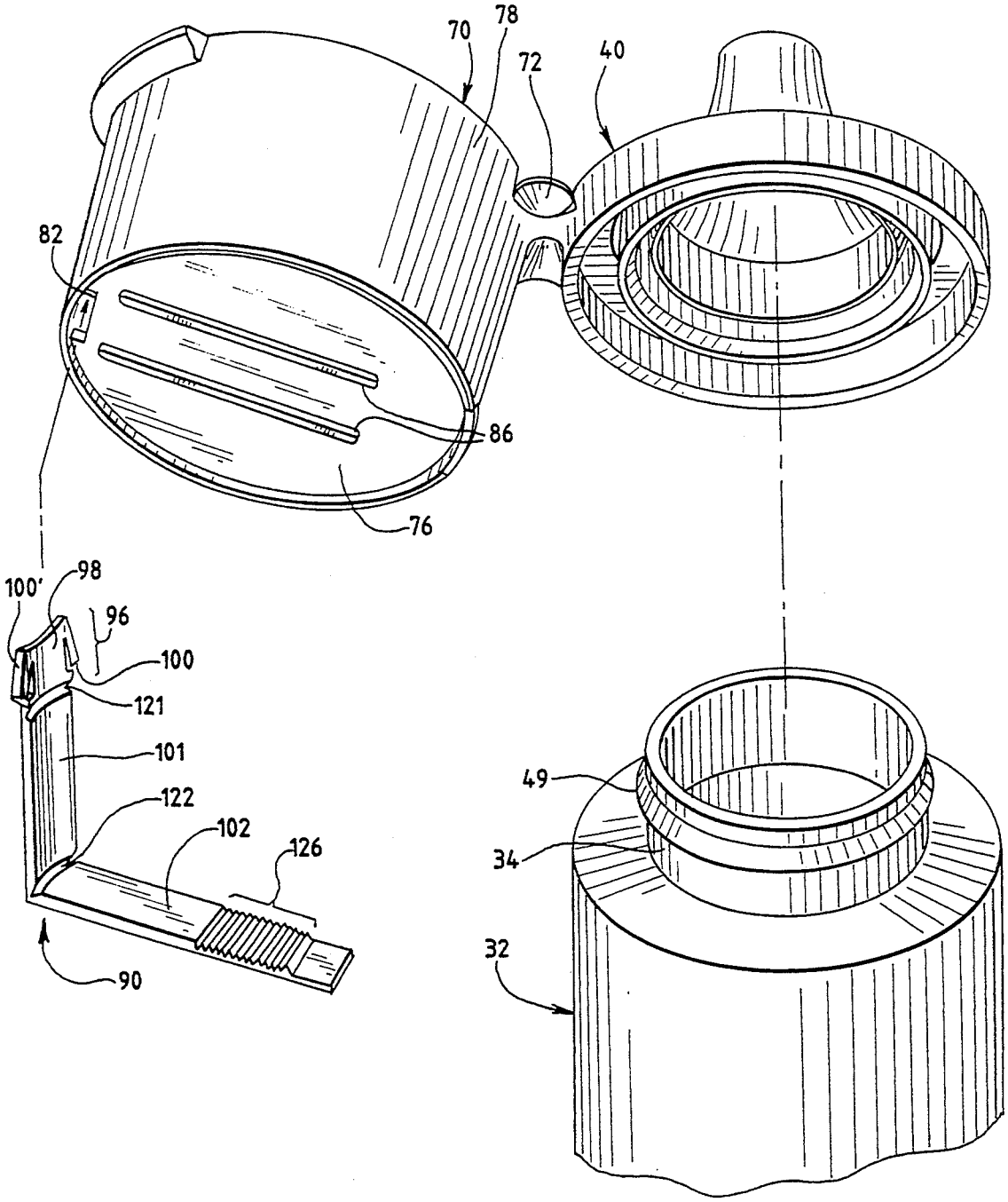
FIG. 7 is an exploded, perspective view showing the process of inserting the tamper-indicating element first segment through the lid aperture during assembly of the closure.

In the preferred method of fabrication, the closure lid 70 and base 40 are initially molded in the open position as a unitary structure shown in FIGS. 4, 5, and 7. Then the lid 70 is closed. The tamper-indicating element 90 is separately molded. The tamper-indicating element 90 is then inserted into the lid 70. To this end, the anchor 96 is pushed through the lid aperture 82. The element 90 is further inserted such that the anchor 96 also passes through the anchor-receiving opening 64 in the base 40. The outwardly divergent arms 100 accommodate temporary deformation as the anchor 96 passes through the opening 64, and each arm 100 is urged inwardly closer to the anchor stem 98.

When the element 90 has been inserted sufficiently into the closure, the arms 100 return to the outwardly divergent orientation (FIGS. 14 and 15). In this orientation, the upwardly facing ends of the arms 100 can engage the engaging surface 66. This prevents removal of the anchor 96 through the opening 64.

The first segment 101 of the element 90 extends from the anchor 96 through the base opening 64, between the base 40 and the lid 70, and through the lid aperture 82. The second segment 102 extends from the first segment 101 and is disposed adjacent the portion of the lid cover panel 76 (e.g., between the ribs 86). This portion of the cover panel functions as a platform against which the second segment 102 can be disposed.

When the tamper-indicating element 90 is properly installed, the first frangible connection 121 is located generally at the lid aperture 82, and the second frangible connection 122 is located generally at the anchor-receiving opening 64 in the base 40.

The placement of the tamper-indicating element 90 in the closure (FIG. 1) generally inhibits the opening of the closure. To open the closure for the first time, the distal end of the second segment 102 is gripped as shown in FIG. 2 and pulled outwardly to separate the second segment 102 from the first segment 101 at the first frangible connection 121. Subsequently, the lid 70 can be pivoted upwardly to an open orientation (FIG. 3). This exposes the upwardly projecting first segment 101. The first segment 101 can then be pulled to separate the first segment 101 from the anchor 96 at the second frangible connection 122. This leaves the anchor stem 98 visible in the anchor-receiving opening 64 of the base 40. This provides an indication that the closure has been opened. The removed first and/or second segment can function as a "proof of purchase" panel or label.

After the second segment 102 has been initially pulled and separated from the first segment 101, the lid 70 can be opened and the contents dispensed through the closure without necessarily removing the first segment 101. However, for convenience, and to avoid interference around the dispensing orifice 62, the user will generally wish to pull the first segment 101 away also.

An alternate embodiment of the tamper-indicating element is illustrated in FIG. 17 wherein it is designated generally by the reference numeral 90A. The element includes an anchor portion 96A having a stem 98A. Two arms 100A both diverge in an orientation radially outwardly relative to the stem 98.

A frangible connection 122A joins the anchor stem 98A to a first segment 101A. The first segment 101A is joined at the other end via a frangible connection 121A to a generally disk-shaped second segment 102A.

The second segment 102A is adapted to be disposed on the top of a closure lid. The first segment 101A and anchor 96A are adapted to be disposed through the closure lid and base in generally the same manner as with the first embodiment of the tamper-indicating element 90 described above with reference to FIGS. 1–16. However, because the second embodiment element 90A has arms 100A which diverge radially outwardly, the structure in the closure base below the aperture (aperture 64 in FIGS. 13–16) would have to be reconfigured as necessary to provide a radially outer ledge or retaining surface against which the distal ends of the arms 100A could be engaged.

The tamper-indicating closure of the present invention gives a clear indication of initial opening of the closure, and this feature can be adapted for use in a variety of dispensing closure designs. The feature can be readily-incorporated in a closure that is not difficult to manufacture. However, the tamper-indicating feature is extremely difficult to defeat. Further, if the tamper-indicating element is pulled apart, then the element cannot be restored and reinstalled in a closure by the ordinary consumer or user who has no access to sophisticated manufacturing techniques.

It will be readily apparent from the foregoing detailed description of the invention and from the illustrations thereof that numerous variations and modifications may be effected without departing from the true spirit and scope of the novel concepts or principles of this invention.

What is claimed is:

1. A tamper-evident dispensing closure comprising a base suitable for attachment to a container, said base having a deck defining a dispensing orifice for communicating with the interior of the container, said base defining an anchor-receiving opening and an adjacent anchor-retention structure;

a lid adapted to be (1) seated on said base in a predetermined orientation to occlude said dispensing orifice, and (2) moved from seated orientation to permit the dispensing of the container contents through said dispensing orifice, said lid defining an aperture spaced from said dispensing orifice when said lid is seated on said base; and a tamper-indicating element having (1) an anchor retained in said opening below said deck by said anchor-retention structure, (2) a first segment extending from said anchor through said base opening, between said base and lid, and through said lid aperture, (3) a second segment extending from said first segment and disposed adjacent a portion of said lid to inhibit movement of said lid from said seated orientation, and (4) a first frangible connection joining said first and second segments at said lid aperture whereby said second segment can be pulled to separate said second segment from first segment at said first frangible connection to permit movement of said lid to expose said first segment as an indication that said closure has been opened.

2. The closure in accordance with claim 1 in which said lid is connected with a hinge to said base; and said lid aperture and base opening are generally aligned when said lid is seated on said base, said aperture and opening each being located generally $180^{4}$ from said hinge.

3. The closure in accordance with claim 1 in which said lid defines a generally flat, transverse, top; and said lid includes a portion which functions as a platform against which said second segment can be disposed.

4. The closure in accordance with claim 1 in which said lid includes a generally cylindrical wall having an interior surface; and said lid defines a pair of spaced-apart, parallel channels along said interior surface below said lid aperture.

5. The closure in accordance with claim 1 in which said base deck has interior surfaces that face the top of said container when said base is mounted on said containers;

one of said interior surfaces defines an engaging surface adjacent said anchor-receiving opening.

6. The closure in accordance with claim 5 in which said anchor includes (a) a central stem, and (b) a pair of arms which have a laterally divergent orientation relative to said stem, said arms being resiliently deflectable to (1) accommodate temporary deformation as said anchor is initially inserted into said anchor-receiving opening and said arms are urged closer together, and (2) substantially return to said laterally divergent orientation engaged with said engaging surface to prevent withdrawal of said anchor from said opening.

7. The closure in accordance with claim 5 in which said engaging surface is a land around a portion of said opening.

8. The closure in accordance with claim 5 in which said anchor includes (a) a stem, and (b) an arm having a radially outwardly divergent orientation relative to said stem, said arm being resiliently deflectable to (1) accommodate temporary deformation as said anchor is initially inserted into said anchorreceiving opening and said arm is urged closer to said stem, and (2) substantially return to said outwardly divergent orientation engaged with said engaging surface to prevent withdrawal of said anchor from said opening.

9. The closure in accordance with claim 5 in which said tamper-indicating element includes a second frangible connection joining said first segment to said anchor at said anchor-receiving opening in said base whereby, after said second segment is initially pulled to separate said second segment from said first segment at said first frangible connection and after said lid is moved to expose said first segment, said first segment can then be pulled to separate said first segment from said anchor at said second frangible connection leaving said anchor visible in said anchor-receiving opening as an indication that said closure has been opened.

10. The closure in accordance with claim 5 in which said tamper-indicating element has a generally right angle configuration.

11. The closure in accordance with claim 5 in which said tamper-indicating element is made from a synthetic polymer material; and said first frangible connection is a web formed from a reduced thickness section of said material across the width of said tamper-indicating element.

12. The closure in accordance with claim 10 in which said material defines a V-shaped notch forming said web.

13. A tamper-evident dispensing closure comprising a base suitable for attachment to a container, said base having a deck defining a dispensing orifice for communicating with the interior of the container, said base defining an anchor-receiving opening and an adjacent anchor-retention structure;

a lid adapted to be (1) seated on said base in a predetermined orientation to occlude said dispensing orifice, and (2) moved from seated orientation to permit the dispensing of the container contents through said dispensing orifice, said lid having a platform defining an aperture located generally above said base anchor-receiving opening when said lid is seated on said base; and a tamper-indicating element having (1) an anchor retained-in said opening below said deck by said anchor-retention structure, (2) a first segment extending from said anchor through said base opening, between said base and lid, and through said lid aperture, (3) a second segment extending from said first segment and disposed adjacent said lid platform to inhibit movement of said lid from said seated orientation, (4) a first frangible connection joining said first and second segments at said lid aperture, and (5) a second frangible connection joining said first segment to said anchor at said anchor-receiving opening in said base whereby said second segment can be initially pulled to separate said second segment from first segment at said first frangible connection to permit movement of said lid to expose said first segment which can then be pulled to separate said first segment from said anchor at said second frangible connection leaving said anchor visible in said base opening as an indication that said closure has been opened.

* * * * *